United States Patent [19]

Hawkinson

[11] 4,268,081

[45] May 19, 1981

[54] REFUSE RECEIVING ASSEMBLY

[76] Inventor: Leon A. Hawkinson, 911 N. Richman, Fullerton, Calif. 92632

[21] Appl. No.: 87,558

[22] Filed: Oct. 22, 1979

[51] Int. Cl.[3] ..... A01B 1/04

[52] U.S. Cl. ..... 294/55; 15/257.1; 248/99

[58] Field of Search ..... 294/55, 1 R, 19 R; 248/99, 101; 15/257.1, 257.4, 257.6, 257.8, 257.7; 141/108; 43/11, 12

[56] References Cited

U.S. PATENT DOCUMENTS 2,731,184 1/1956 Thurber, Jr. ..... 248/99

4,128,055 12/1978 Hellmann ..... 248/101

4,149,745 4/1979 Willis ..... 15/257.1

*Primary Examiner*—James B. Marbert

*Attorney, Agent, or Firm*—William C. Babcock

[57] ABSTRACT

A refuse receiving assembly that removably supports an elongate plastic bag in an expanded position, with the assembly and bag when in a first horizontal position capable of having refuse swept into the bag, and the assembly and bag when in a second position supporting the bag substantially vertical. When the bag is vertically disposed the refuse may be compacted by a tamper that preferably forms a part of the assembly. After the refuse is compacted in the vertically disposed bag, the assembly may be lifted upwardly out of the bag, and the upper end of the bag tied to maintain the refuse therein.

2 Claims, 4 Drawing Figures

FIG. 1
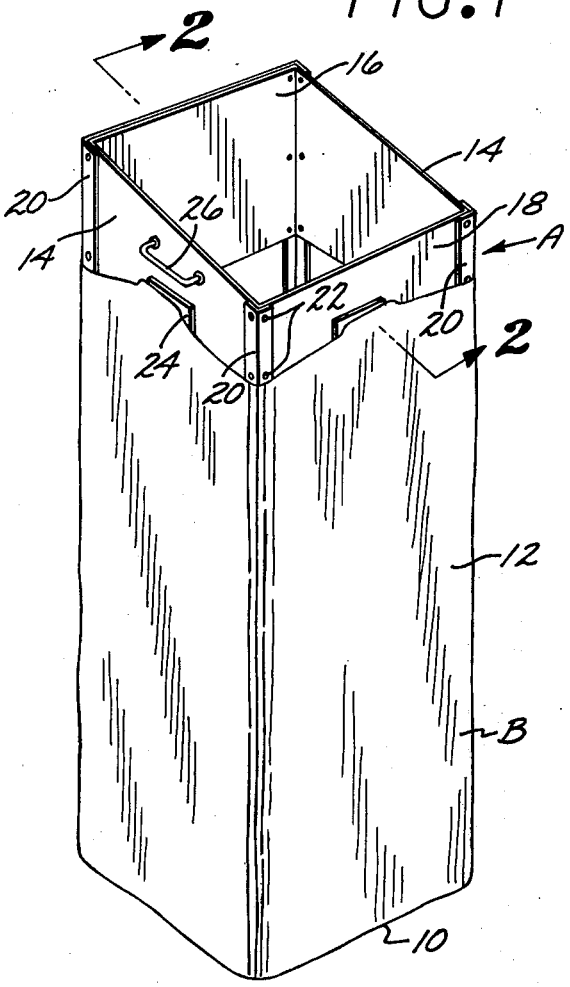
FIG. 2
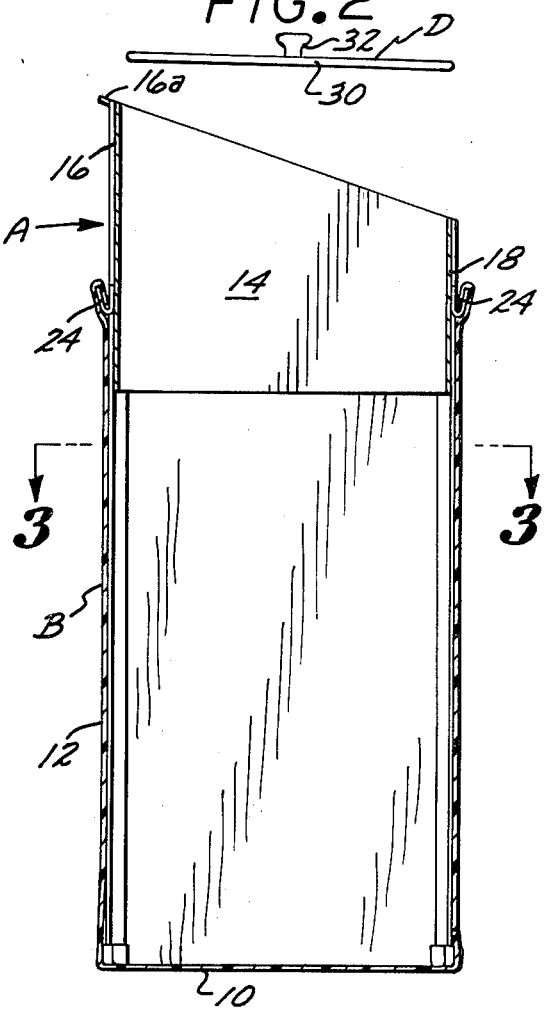
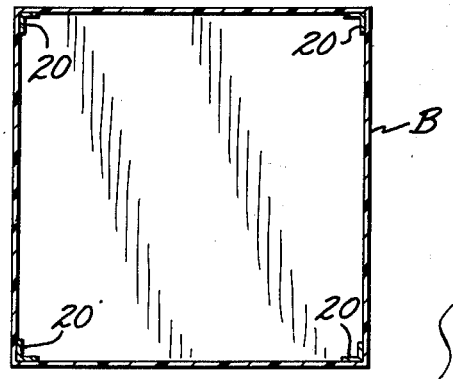
FIG. 3
FIG. 4
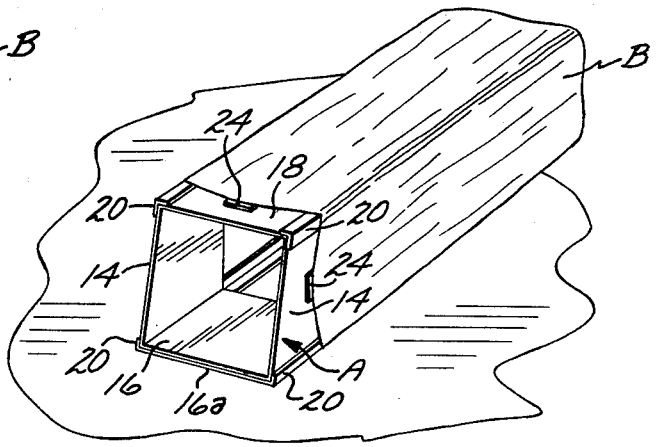

REFUSE RECEIVING ASSEMBLY

BACKGROUND OF THE INVENTION

1. Field of the Invention

Refuse receiving assembly.

2. Description of the Prior Art

In recent years, plastic bags have become increasingly popular as a receptacle for unwanted material such as refuse, grass clippings, pieces of shrubbery and the like as well as materials that may be of a hazardous nature. An operational difficulty in utilizing such plastic bags for refuse containing purposes, is maintaining the bags in open expanded positions in which the refuse may be swept without contacting the user of the bags. Various devices have been proposed and used to a limited extent that seek to maintain the bag in an open expanded position, but such devices have been of an unduly complicated nature. In addition, such bag holding devices have been cumbersome, heavy and bulky to move around, and so expensive that they have not come into widespread useage.

A major object of the present invention is to provide a lightweight portable assembly that is of inexpensive construction, and one that may be easily used to support a plastic bag in an expanded position, with the assembly and bag capable of being disposed in a first horizontal position on the supporting ground surface where refuse may be swept into the bag without contacting the user, and the bag and assembly after having materials swept therein capable of being vertically disposed in a second position where refuse may be tamped out and compacted in the bag.

SUMMARY OF THE INVENTION

The assembly of the present invention is used in combination with a conventional elongate plastic trash-receiving bag to maintain the latter in an expanded position. The assembly when removably supporting the bag may be disposed in a first position to rest horizontally on the ground surface to permit refuse to be swept into the bag without contacting the user, and the assembly and bags that is partially or wholly filled with refuse capable of being disposed in a vertical position where the refuse may be compacted by being pressed downwardly into the bag with a tamper or other means. After the refuse has been compacted in a vertically disposed bag the assembly may be raised outwardly above the bag and disengaged therefrom, with the bag having the upper portion thereof tied or knotted to prevent the refuse spilling therefrom.

The trash receiving housing includes a pair of spaced parallel side walls, first and second end walls that extend therebetween to define a substantially square passage within the confines thereof through which the trash is swept. The side walls and end walls above-identified are held in the square configuration by four legs, preferably of L-shaped transverse cross section, that engage the adjacent corners of the side walls and end walls and are secured thereto by a rivet or other fastening means. The side walls and end walls have clips extending outwardly from the exterior surfaces thereof over which the upper edge portions of the bag may be looped to support the bag in expanded configuration, with the legs extending downwardly into the bags to contact the bottom thereof, and the bottom of the bags and the lower end portions of the legs resting on the ground surface. The side walls or end walls preferably have handles extending outwardly from the upper exterior portions thereof, which permit the assembly and bag to be disposed in either a horizontal or vertical position, and the handles also serving to lift the housing and supporting legs that comprise the assembly from the interior of the bag, by the assembly being manually lifted upwardly and separated from the bag and refuse situated therein. The refuse containing bag after this operation has been completed has the upper portion thereof tied or knotted to prevent refuse discharging therefrom.

BRIEF DESCRIPTION OF THE DRAWING

FIG. 1 is a perspective view of the assembly vertically disposed and removably supporting a refuse receiving bag in an upright expanded position;

FIG. 2 is a vertical cross sectional view of the assembly and bag taken on the line 2—2 of FIG. 1;

FIG. 3 is a transverse cross sectional view of the bag and the legs that form a part of the assembly; and FIG. 4 is a perspective view of the assembly and expanded bag in a horizontal position and resting on the ground surface, with the assembly and bag capable of having refuse swept into the bag without contacting the user.

DESCRIPTION OF THE PREFERRED EMBODIMENT

The refuse receiving assembly A as may best be seen in FIGS. 1 and 4 is used in conjunction with an elongate conventional plastic bag B, of the type currently used for having refuse disposed therein for disposal purpose. The plastic bag B has a bottom 10 and an elongate continuous side wall 12 that extends upwardly therefrom as shown in FIG. 1.

The refuse receiving assembly A includes a housing C that is defined by sheet material. The sheet material is formed to define a pair of side walls 14, a first end wall 16 and a second end wall 18. The housing C as illustrated has the first end wall 16 of substantially greater length than that of the second side wall 18. The first side wall 16 preferably has a lip **16*a* that extends upwardly and outwardly therefrom as shown in FIG. 2. The purpose of the lip will later be explained. Four elongate legs 20 are provided that are of transverse L-shaped cross section, with the legs shown in FIG. 1 overlapping the corner post portions of the side walls and end walls, and being secured to the side walls and end walls by rivets 22** or other conventional fastening means.

The side walls and end walls 14, 16 and 18 have clips 24 that extend upwardly and outwardly therefrom as viewed in FIG. 1. Also, the housing on oppositely disposed sides thereof has a pair of handles 26 extending outwardly therefrom. The legs 20 preferably have pads of conventional structure on the lower ends thereof to prevent the legs tearing the bottom 10 of the bag B when the legs extend downwardly therein as shown in FIG. 2. In FIG. 2 it will be seen that a tamping member D is provided that is formed from a rigid sheet 30 of such dimensions as to be vertically movable downwardly inside the housing C and the seat 30 having a handle 32 extending upwardly from substantially the center thereof.

The refuse receiving assembly A is used by lowering the same into the plastic bag B or drawing the plastic bag B upwardly over the legs 20 as shown in FIG. 1, with the upper portion of the bag being looped over the clips 24 as illustrated in FIG. 2. When the assembly A and bag B are in the first position as shown in FIG. 4, the lip 16*a* rests on the ground surface E and refuse (not shown) may be swept into the housing C and from there into the bag B by tilting the assembly and bag upwardly from the ground E. The assembly A and plastic bag B may be periodically disposed in the second positions shown in FIGS. 1 and 2 where the tamping member D may be used to compact the refuse (not shown) in the bags B. The compacting of the refuse in the bag B is accomplished by alternately moving the tamping member D downwardly in the housing C.

When the bag B has become filled with refuse, and is in the second position illustrated in FIGS. 1 and 2, the handles 26 are used to move the assembly out of the bag B, with the bag having the upper portion thereof tied or secured to prevent refuse falling therefrom.

The use and operation of the invention has been previously explained in detail and need not be repeated.

What is claimed is:

1. In combination with a pliable trash receiving plastic bag of the type that includes a bottom and a continuous side wall that extends upwardly therefrom an assembly for selectively supporting said bag in either a first substantially horizontal position where refuse may be moved from the supporting ground surface into the bag or a second position where the bag is vertically disposed after being filled with refuse, said assembly when in said second position capable of having said assembly lifted upwardly therefrom to permit said bag to have the upper portion thereof tied to maintain the refuse within the confines thereof, said assembly including:

a. a trash receiving housing that includes a pair of spaced parallel side walls, a first and second parallel end walls that extend between said pair of side walls and occupy fixed positions relative thereto, said first end wall of substantially greater length than said second end wall, said housing of such generally square transverse cross-section as to snugly engage the interior of said bag when the latter is extended thereover said first end wall having a first transverse edge;

b. four rigid legs secured in equally spaced relationship to said housing and extending downwardly therefrom, with said legs of such length that said housing when in said second position has the lower portion thereof disposed above the supporting ground surface a distance less than the height of said bag;

c. first means on the exterior of said housing for removably securing upper portions of said side wall of said bag thereto when said legs extend downwardly in said bag to contact said bottom thereof, with said housing and legs cooperating to maintain said bag in an expanded configuration to receive said refuse both when said bag is in a vertical or horizontal position;

d. at least on U-shaped handle on the exterior of the said side walls of said housing for manually disposing said assembly in said first position with said first end wall downwardly disposed and at least partially resting on said ground supporting surface to permit refuse to be moved into said expanded bag supported on said housing and legs, with said handle when said bag is filled with refuse being used to pivot said assembly and bag to an upright position where said assembly may be lifted from said bag filled with refuse, and the upper portion of said bag thereafter being tied or otherwise secured to prevent refuse falling therefrom; and e. a lip on the said transverse edge of said first end wall that extends downwardly and outwardly therefrom when said assembly is in said first position to rest on said ground supporting surface and to assist in sweeping said refuse from said ground supporting surface into the interior of said housing and bag.

2. An assembly as defined in claim 1 in which said first means are a plurality of spaced clips that extend outwardly from said housing over which upper portions of said bag may be looped.

* * * * *